US008534124B2

(12) United States Patent
Vornbrock et al.

(10) Patent No.: US 8,534,124 B2
(45) Date of Patent: Sep. 17, 2013

(54) SENSOR HOUSING APPARATUS

(75) Inventors: Theodore John Vornbrock, Stevensville, MD (US); Aaron Matthew Foulk, Woodbridge, VA (US)

(73) Assignee: Raytheon Company, Waltham, MA (US)

( * ) Notice: Subject to any disclaimer, the term of this patent is extended or adjusted under 35 U.S.C. 154(b) by 405 days.

(21) Appl. No.: 12/881,661

(22) Filed: Sep. 14, 2010

(65) Prior Publication Data

US 2011/0061454 A1 Mar. 17, 2011

Related U.S. Application Data

(60) Provisional application No. 61/243,259, filed on Sep. 17, 2009.

(51) Int. Cl.
*E21B 49/00* (2006.01)

(52) U.S. Cl.
USPC ..... 73/152.16; 73/591; 73/431

(58) Field of Classification Search
USPC ..... 73/431, 591, 152.16
See application file for complete search history.

(56) References Cited

U.S. PATENT DOCUMENTS

| | | | | |
|---|---|---|---|---|
| 4,229,122 | A | 10/1980 | Ballantyne | |
| 4,775,009 | A | 10/1988 | Wittrisch et al. | |
| 5,119,089 | A * | 6/1992 | Khalil | 340/855.2 |
| 6,135,204 | A | 10/2000 | McCabe et al. | |
| 6,262,945 | B1 | 7/2001 | Maples et al. | |
| 6,294,727 | B1 | 9/2001 | Orlean | |
| 6,363,785 | B1 | 4/2002 | Senghaas et al. | |
| 6,415,824 | B2 | 7/2002 | Stephens | |
| 6,502,634 | B1 | 1/2003 | Evans et al. | |
| 7,000,697 | B2 | 2/2006 | Goode et al. | |
| 7,048,061 | B2 * | 5/2006 | Bode et al. | 166/227 |
| 7,070,359 | B2 | 7/2006 | Richardson et al. | |
| 7,219,729 | B2 | 5/2007 | Bostick, III et al. | |
| 7,270,177 | B2 | 9/2007 | Vercaemer | |
| 8,286,701 | B2 * | 10/2012 | Schultz et al. | 166/242.6 |
| 2003/0146002 | A1 * | 8/2003 | Vinegar et al. | 166/384 |
| 2005/0059957 | A1 * | 3/2005 | Campbell et al. | 604/524 |
| 2008/0000639 | A1 * | 1/2008 | Clark et al. | 166/281 |

* cited by examiner

*Primary Examiner* — Hezron E Williams
*Assistant Examiner* — Paul West
(74) *Attorney, Agent, or Firm* — Daly, Crowley, Mofford & Durkee, LLP

(57) ABSTRACT

A sensor apparatus includes a first elongated housing to at least partially enclose a sensor device and a second elongated housing coupled longitudinally to the first elongated housing. The second elongated housing includes at least one radial port extending from an inner surface to an outer surface of the second elongated housing to allow a first material received through an opening of the second elongated housing to flow through the second elongated housing and out the radial port in the vicinity of the sensor apparatus.

26 Claims, 9 Drawing Sheets

SENSOR HOUSING APPARATUS

RELATED APPLICATIONS

This application claims the benefit of U.S. Provisional Application No. 61/243,259 filed Sep. 17, 2009 under U.S.C. §119(e) which application is hereby incorporated by reference in its entirety.

BACKGROUND

As is known in the art, there are many reasons for placing sensors, probes, and various kinds of detection instrumentation in subterranean environments. For example, the petroleum industry may use subterranean sensor arrays to study geophysical properties of the deep earth to assist in crude oil exploration and extraction. Construction teams drill boreholes into the earth and install sensor arrays, typically encased in a protective jacket. Once the sensory array is in place, grout may be injected into the borehole cavity to surround the sensor array and to attempt to uniformly couple the sensor array with the surrounding earth. One of the main goals of a drilling operation is to maximize sensor array accuracy and sensitivity by forming a tight acoustical and/or seismic coupling between the sensor array and the surrounding earth.

As is also known in the art, many sensor arrays lack both the strength and ruggedness to survive horizontal directional drilling (HDD) operations. To accommodate these weaker sensor arrays, drilling teams may excavate an open trench, dispose the sensor array at the bottom of the trench, and backfill the trench with grout and/or soil to cover the sensor array. However, open trench excavation may result in voids and air cavities in the surrounding earth, which can significantly impede sensor array performance. Furthermore, open trench excavation often involves moving relatively large amounts of earth, which can be expensive, time-consuming, and is disruptive of the surrounding area.

Open trench excavation may be useful under certain conditions, such as when space is limited or for shallow-depth applications. These installations are often limited to depths of 20 feet or less, and more typically involve depths of ten, five, or even fewer feet. Sensor arrays have limited application at such shallow depths, although construction teams can use them to detect vibrations in manholes and other underground tunnels near the surface.

As is also known in the art, directional boring (so-called "horizontal directional drilling" or HDD) is another technique that industry uses to install sensor arrays and other subterranean devices. Drilling operations often employ HDD where direct-cut open trenching is undesirable or too disruptive. Also, HDD may involve drilling at relatively large depths, such as to install piping under a canal and or to assist in oil exploration.

HDD is a steerable, trenchless method in which teams install devices in a three-stage process including drilling a pilot hole, enlarging the hole, and depositing the device within the larger hole. Drilling teams uses a viscous fluid to help cool the drill bit, remove loosened soil, and to stabilize the hole. To help stabilize the device and to attempt to fill all voids and produce a tight coupling, teams often introduce a grout through one end of a tube or conduit which also contains the installed device. The tube may be retreated back up the opening or pulled through the entire borehole when the team determines (e.g., using sensors) that they have deposited a sufficient amount of grout to stabilize the borehole cavity and/or crevices in the earth.

For example, HDD may be used to install high-power electrical cable which must be uniformly coupled to the surrounding medium, such as the earth, to promote heat transfer from the cables. One suitable material used to protect the cable includes high-density polyethylene (HDPE) plastic. HPDE offers an acoustical impedance similar to that of compact soil or soft rock. HPDE is also rugged, abrasion resistant, waterproof, and relatively inexpensive.

SUMMARY

In general overview, the inventive concepts, systems, and techniques described herein provide a sensor apparatus including a rugged, high-strength sensor housing to house sensors and a material delivery housing to conduct a material into an area about the sensor apparatus to secure and/or couple the sensors to surrounding medium. The inventors realized that integrating the sensor housing with the material delivery housing can facilitate the uniform distribution of coupling material along a length of the sensor apparatus. Moreover, the sensor apparatus has improved tensile strength and ruggedness, making it particularly useful for horizontal directional drilling installations. For example, the sensor apparatus may resist kinking and tangling, and may minimize sensor hardware breakage during installation.

Optionally, a strength member may be included to further increase ruggedness and tensile strength of the sensor apparatus. A lumen may be formed in the strength member and communications devices disposed therein to enable communications between a first portion and a second portion along the length of the sensor apparatus.

The material delivery housing wall defines radial ports to conduct a material about the sensor apparatus. The radial ports distributed about the material delivery housing can help produce an intimate coupling of the sensors to the surrounding soil and can be configured to produce fluid/backfill pressure gradients to suite soil/rock fluid-permeability characteristics. In some applications, the density of radial ports along a length of the material delivery housing may be either varied or held constant to control material flow into a surrounding bore hole. The density of radial ports may be expressed as a total radial port cross-sectional area per linear foot of material delivery housing. Other design factors, such as radial port size, shape, and number may be configured to uniformly distribute the material and/or to accommodate material viscosity, density, and other properties. Such other properties may include variation in fluid pressures anticipated due to installation of portions of the sensor apparatus at different depths along a curved borehole path. Lower portions subject to higher fluid pressures may have a lower total cross-sectional area of radial ports to equalize the flow rate of a material with that of sensor apparatus portions disposed at shallower depth, where fluid pressure may be lower.

In one aspect, a sensor apparatus includes a first elongated housing to at least partially enclose a sensor device and a second elongated housing generally parallel to the first elongated housing. The second elongated housing defines at least one radial port extending from an inner surface to an outer surface of the second elongated housing adapted to conduct a material through the second elongated housing and out the radial port about the sensor apparatus.

In a further embodiment, the sensor apparatus includes one or more of the following features: the first elongated housing has a generally circular cross-sectional area and the second elongated housing has a generally circular cross-sectional area and the outer surface of the second elongated housing is coupled along a length of the sensor apparatus to an outer surface of the first elongated housing; the first elongated housing has a first radius and the second elongated housing has a second radius, wherein the first radius is larger than the second radius; the first elongated housing has a wall having a first thickness and the second elongated housing has a wall having a second thickness, the second thickness larger than the first thickness; the first elongated housing has a generally triangular cross-sectional area and the second elongated housing has a generally triangular cross-sectional area; the first elongated housing has a wall having a first thickness and the second elongated housing has a wall having a second thickness, the second thickness larger than the first thickness; the sensor apparatus has a generally oval-shaped cross-sectional area, the first elongated housing disposed within a first portion of the oval-shaped cross-sectional area and the second elongated housing disposed within a second portion of the oval-shaped cross-sectional area; the sensor device includes a sensor string at least a portion of which is coupled to an inner surface of the first elongated housing to enhance sensor sensitivity, the sensor string including at least one of: a plurality of acoustic sensors and a plurality of seismic sensors; a coupling material formed about the sensor device couples the sensor device to the inner surface of the first elongated housing; the coupling material includes a fluid material; an inner surface and an outer surface of the first elongated housing form a first wall having a thickness configured to enhance sensor sensitivity and an inner surface and an outer surface of the second elongated housing form a second wall having a thickness to enhance tensile strength of the sensor apparatus; the at least one radial port includes a plurality of radial ports arranged in a helical pattern along a length of the second elongated housing; the at least one radial port includes a plurality of radial ports arranged at a density along a length of the second elongated housing to support uniform distribution of the material; the at least one radial port includes a plurality of radial ports, further including an inner housing disposed within at least a portion of the second elongated housing to block distribution of the material through at least one of the radial ports; further including an elongated member coupled longitudinally to at least one of the first and second elongated housings; the first elongated housing has a generally triangular cross-sectional area and the second elongated housing has a generally triangular cross-sectional area and the elongated member is housed within one of the first and second elongated housings; the sensor apparatus has a generally oval-shaped cross-sectional area, first elongated housing disposed within a first portion of the oval-shaped cross-sectional area, the second elongated housing disposed within a second portion of the oval-shaped cross-sectional area, and the elongated member disposed within at least one of the first and second portions; electronics are disposed in a lumen formed within the elongated member.

In another aspect, a sensor apparatus includes an elongated sensor body forming a first lumen into which a sensor device may be inserted and a second lumen having a portion parallel to the elongated sensor body and a radial port portion extending from the portion parallel to the elongated sensor body to an outer surface of the elongated sensor body. The second lumen acts to conduct a material through the parallel portion of the second lumen and through the radial port portion of the second lumen to a position about the sensor apparatus.

In a further embodiment, the sensor apparatus includes one or more of the following features: the first lumen has a generally circular cross-sectional area and the second lumen has a generally circular cross-sectional area; the sensor device includes a sensor string at least a portion of which is coupled to an inner surface of the first lumen to enhance sensor sensitivity, the sensor string including at least one of a plurality of acoustic sensors and/or a plurality of seismic sensors; a coupling material formed about the sensor string couples the sensor to the inner surface of the first lumen, the coupling material including a fluid material; an inner surface and an outer surface of the first lumen form a first wall having a thickness configured to enhance sensor sensitivity and an inner surface and an outer surface of the second lumen form a second wall having a thickness to enhance tensile strength of the sensor apparatus; the radial port portion includes a plurality of radial port portions arranged in a helical pattern along a length of the second lumen; the radial port portion includes a plurality of radial port portions, further including an inner member disposed within at least a portion of the second lumen to block distribution of the material through at least one of the radial port portions; the elongated sensor body further forms a third lumen and further including a strength member located within the third lumen.

In another aspect, a method for installing a sensor apparatus includes providing a first elongated housing to at least partially enclose a sensor device and providing a second elongated housing coupled longitudinally to the first elongated housing. The second elongated housing includes at least one radial port extending from an inner surface to an outer surface of the second elongated housing and conducting a material through the at least one radial port about the sensor apparatus, the material received through an opening of the second elongated housing.

In further embodiments, the method includes one or more of the following features: coupling the sensor device to an inner wall of the first elongated housing, and; forming an opening in a wall of the first elongating housing to insert at least a portion of the sensor device within the first elongating housing.

BRIEF DESCRIPTION OF THE DRAWINGS

The foregoing features of this invention, as well as the invention itself, may be more fully understood from the following description of the drawings in which.

DETAILED DESCRIPTION

Figure 1A:
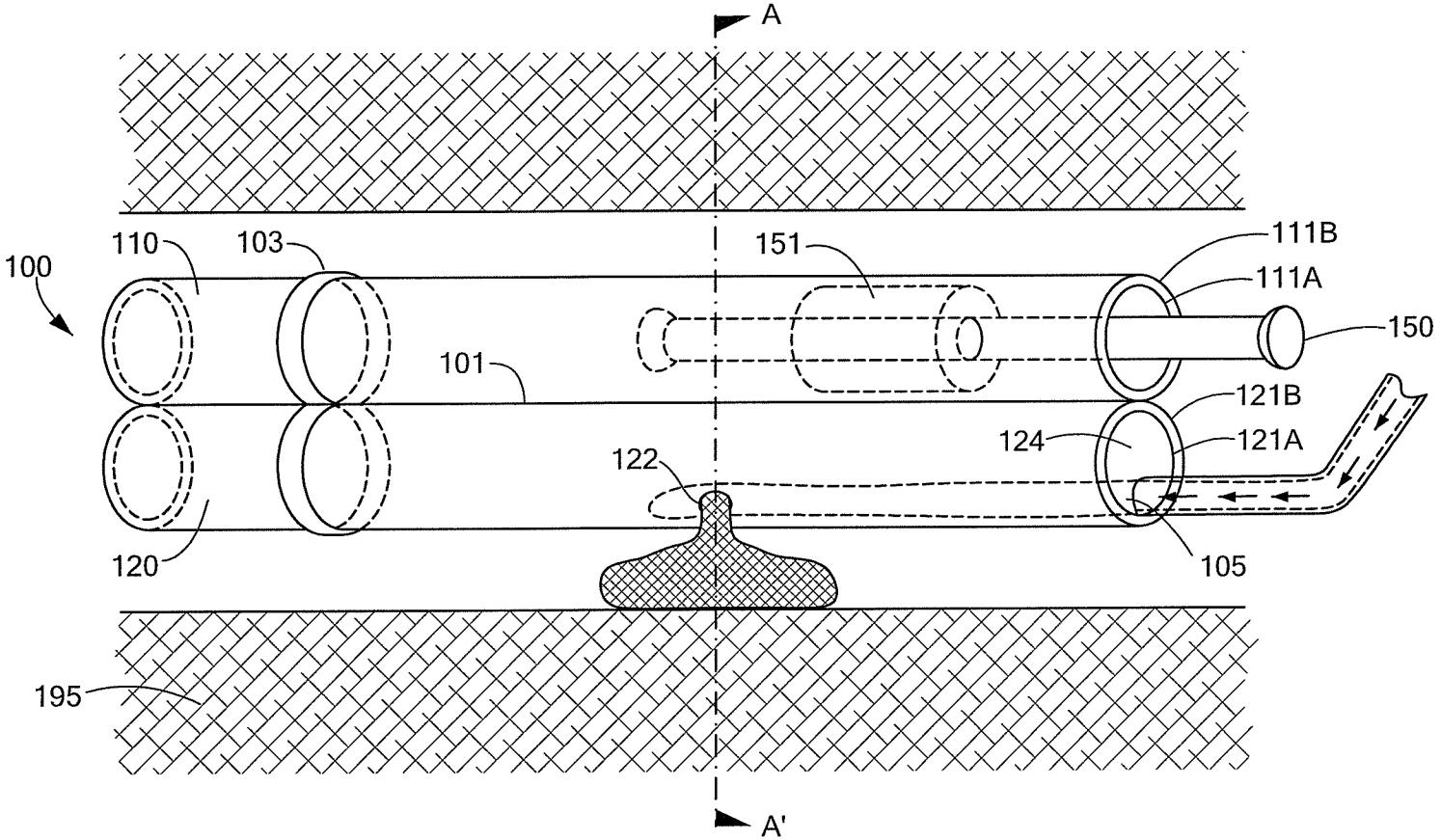
FIG. 1A is a pictorial representation of a sensor apparatus in accordance with the inventive systems, techniques, and concepts.

Referring now to FIG. 1A, in one aspect the inventive systems, techniques, and concepts includes sensor apparatus 100 including first elongated housing 110 to at least partially enclose sensor device 150 and second elongated housing 120 generally parallel to first elongated housing 110. Second elongated housing 120 defines at least one radial port 122 extending from inner surface 121A to outer surface 121B of second elongated housing 120 which allows material 105 received through opening 124 of second elongated housing 120 to flow along the interior of second elongated housing 120. Material 105 flows out radial port 122 and at least partially fill in voids created between first elongated housing 110 (with sensor device 150 therein) and second elongated housing 120 and surrounding medium 195 as well as the void defined by second elongated housing 120 such that sensor apparatus 100 is coupled to surrounding medium 195.

In a further embodiment, first elongated housing 110 has a generally circular cross-sectional area and second elongated housing 120 has a generally circular cross-sectional area. It will be understood by one of ordinary skill in the art that different cross-sectional areas may be used for at least one of first and second elongated housings 110, 120 depending on the sensor application. Exemplary cross-sectional embodiments will be described further below. It should also be noted that the sensor apparatus 100 is not limited to first elongated housing 110 and second elongated housing 120, any may include two, three, four, or more first elongated housings 110, as may be the case to provide multiple sensor devices 150, and/or two, three, four, or more second elongated housings 120, as may be beneficial to fine-tune the conducting of material 105 about sensor apparatus 100.

First and second elongated housings 110, 120 are coupled at outer surface 111B of first elongated housing 110 and outer surface 121B of second elongated housing 120 along a length of sensor apparatus 100, which may include the entire length of sensor apparatus 100. Various methods may be used to couple housings 110, 120, including, but not limited to, epoxy and/or adhesive tape disposed along outer surfaces 111B, 121B to fixedly couple housings 110, 120. In still other embodiments, first and second elongated housings 110, 120 are extruded together as part of an extrusion process which may involve melting raw plastic materials and forming them into a continuous profile as may be similar to that shown in the sensor apparatus embodiment of FIG. 1A.

It will be understood to one of ordinary skill in the art that first and second elongated housings 110, 120 may be coupled longitudinally in other ways. As by way of a non-limiting example, at least one coupler body (an example of which is designated by reference numeral 103) may be disposed crosswise about sensor apparatus 100 along outer surface 111B of first elongated housing 110 and outer surface 121B of second elongated housing to fixedly join housings 110, 120. One method for fixing housings 110, 120 in this way includes positioning unformed coupler body 103 loosely around sensor apparatus 100 and heat shrinking coupler body 103 until it tightly wraps around housings 110, 120, forming a secure bond. In a further embodiment, coupler body 103 is a band of material that can further strengthen sensor apparatus 100, such as by resisting unwanted folding and twisting which may affect the uniform distribution of material 105 about sensor apparatus 100.

A suitable material for at least one of the first and second elongated housings 110, 120 includes, but is not limited to, high-density polyethylene (HDPE). HDPE is a low-cost, flexible, waterproof, abrasion-resistant material that can be readily cut, drilled, and thermally fusion-welded using conventional tools and existing commercial off-the-shelf equipment. HPDE has an acoustical impedance that can match that of a typical soil and/or rock (for example, an impedance in the range of about 1 mega-rayleigh (Mrayls) to about 10 Mrayls, and in particular, from about 1 Mrayls to about 3 Mrayls). It will be understood by one of ordinary skill in the art that higher impedances greater than 10 Mrayls may be experienced, such as for hard rock, and that appropriate materials may be used to match such impedances.

As described above with reference to FIG. 1A, first elongated housing 110 at least partially encloses sensor device 150. Sensor device 150 includes, but is not limited to, a hydrophone, geophone, accelerometer, magnetometer, electromagnetic radio-frequency receiver and transceiver, and/or another type of sensor that detects vibrations, pressure, and/or stress about sensor apparatus 100. Still other type of sensor devices 150 include those capable of measuring and/or monitoring on a periodic or continuous basis pressure, voltages/currents, gravitational forces, gamma rays, and magnetic fields and resonances. In other embodiments, sensor device 150 is a sensor string which includes one or more of the above sensors or a combination thereof.

In a further embodiment, sensor device 150 is coupled to inner surface 111A of first elongated housing 110. The method of coupling sensor device 150 depends on factors such as the type of sensor 150 and the characteristics of surrounding medium 195. For example, in some applications, a pressure or stress sensor such as a hydrophone must be capable of detecting minute compression and rarefaction variations in medium 195 about sensor apparatus 100. This can be achieved by potting a hydrophone sensor in adhesive or elastomeric substance (a portion of which is designated by reference numeral 151), filling substantially all of the volume between the hydrophone sensor and inner surface 111A of first elongated housing 110. Non-limiting examples of an adhesive or elastomeric substance include urethane rubber, silicone oil, gel, or other suitable dielectric fluids such as deionized water.

As is known in the art, potting is a process of filling a completed electronic assembly with a solid compound for resistance to shock and vibration, and for exclusion of moisture and corrosive agents. Thermosetting type plastics are often used in this process. Conformal coating is another method which may be used to, for example, coat circuit board assemblies with a layer of transparent conformal coating. Advantageously, conformal coating provides many of the benefits of potting, yet can be lighter and easier to inspect, test, and repair.

In other embodiments, a pressure/stress sensor such as a hydrophone can be coupled to inner surface 111A of first elongated housing 110 by mechanically wedging or fastening the hydrophone firmly into place within first elongated housing 110. Still another method of pressure/stress sensor coupling includes filling the inner area of first elongated housing 110 with a gel or a fluid such as water or oil (e.g., silicone or castor).

Advantageously, fluid coupling of sensor devices may offer enhanced coupling and higher signal amplitudes due, in part, to a combination of fluid resonance effects and mechanical mode conversions. Furthermore, fluid coupling may enable higher received signals in comparison to solid coupling (e.g. solid coupling using a cured cementatious material) and may provide more intimate coupling of sensor device having complex surfaces.

In other embodiments in which sensor device 150 is a geophone or an accelerometer, sensor device 150 may be fastened or adhered to one portion of inner surface 111A of first elongated housing 110 using, for example, a screw, rivet, epoxy, and/or other types coupling devices and/or methods.

Embodiments of radial port 122 will now be described in more detail. In general overview second elongated housing 120 defines a port which may be a variety of shapes and extends generally through second elongated housing 120 and is herein referred to as radial port 122. Radial port 122 is configured to conduct material 105 from the interior of second elongated 120 housing to flow about both first and second elongated housings 110, 120 and consequently about sensor apparatus 100. Material 105 includes, but is not limited to, a grout material that can be configured to match the impedance characteristics of the surrounding medium 195 such as surrounding soil and/or subsurface materials. Material 105 may include various fluids and compounds with different viscosities. For example, material 105 may include a cement slurry or a chemical compound.

Figure 1B:
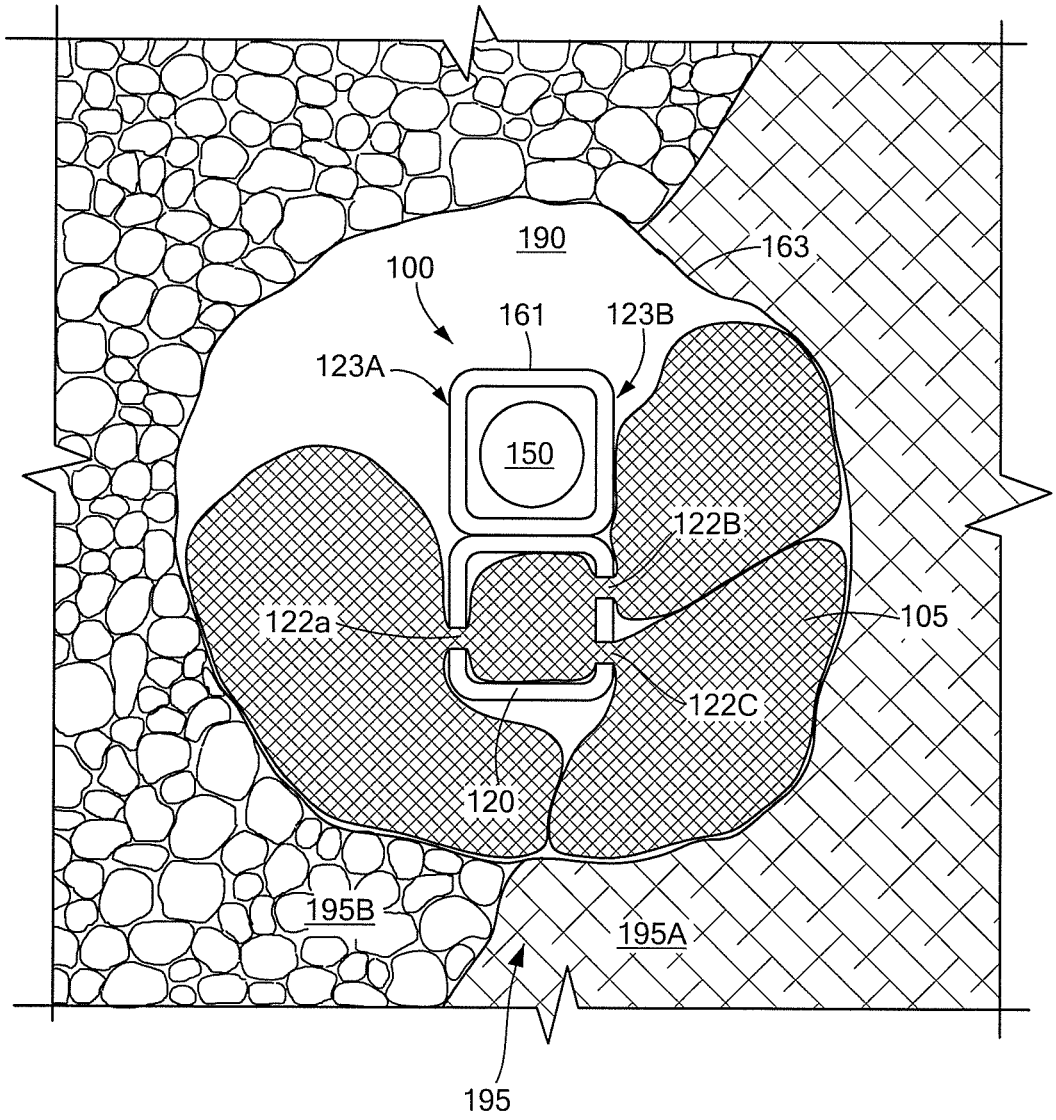
FIG. 1B is a cross-sectional view of a further embodiment of the sensor apparatus shown in FIG. 1A at line AA'.

Referring now to FIG. 1B in which a cross-sectional view of sensor apparatus 100 of FIG. 1A at line AA' is shown, and in which like elements of FIG. 1A are shown with like reference numerals, material 105 is conducted within second elongated housing 120 through radial ports 122A, 122B, 122C and about sensor apparatus 100. As can be seen in FIG. 1B, material 105 flows into area 190 defined by outer surface 161 of sensor apparatus 100 and a cavity, which may be borehole 163 drilled during horizontal-directional drilling (HDD) operations described above. The cavity may further include crevices and other natural or manmade volumes formed about the borehole, such as cracks and fissures in bedrock and other tunnels and voids that may intersect with borehole 163. In such instances, it may be desired to conduct material 105 into these other areas as well so that material 105 is distributed uniformly about sensor apparatus 100 for optimal sensor sensitivity, accuracy, and reliability.

Radial ports 122A, 122B, 122C may be configured in a multitude of ways depending on the particular needs of the sensor application. For example, as shown in FIG. 1B, radial port 122A may be formed on one side 123A of second elongated housing 120, and radial ports 122B, 122C may be formed on an opposing side 123B of second elongated housing 120. Such a configuration enables material 105 to flow at disparate rates into area 190 about sensor apparatus 100.

Material 105 improves the coupling between surrounding medium 195 and sensor device 150. Surrounding medium 195 may include different medium types, such as solid bedrock 195A and sandy loam material 195B. The improved material coupling can provide an impedance matching that is better than that of a void in which no material is disposed.

Advantageously, improved impedance matching between material 105 and surrounding medium 195 can significantly improve sensor accuracy and reliability. For example, seismic impedance depends on both mass-density and speed of sound. The mass-density of material 105 can be configured to approximate (or substantially equal) that of the mass-density of surrounding medium 195. In this way, material 105 better couples seismic energy between t surrounding medium 195 and t sensor device 150 than air voids in which no material is disposed.

Referring again to FIG. 1A, in the same or different embodiment, radial port 122 may be configured in other ways, such as by varying the density and/or number of radial ports. Still further, the shape and/or size of one or more of radial ports 122 may be configured depending on the needs of the sensor application. For example, the shape of radial port 122 may include, but is not limited to, a generally circular shape, a triangular shape, and/or a slotted shape in order to favor flow of material into the adjacent area in one dimension. In another example, the diameter of a radial port may be made larger or smaller to respectively increase or decrease the flow rate of material into an area adjacent to the radial port.

Figure 2A:
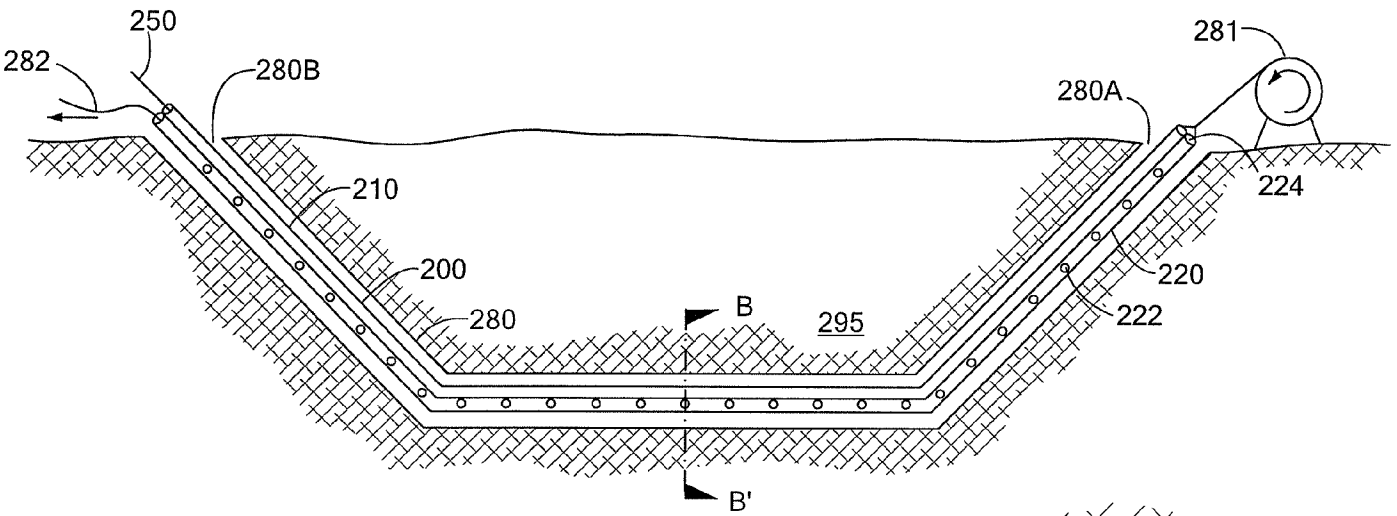
FIG. 2A is a pictorial representation of a sensor apparatus installed in an exemplary subterranean environment.

Referring now to FIG. 2A, in operation, sensor apparatus 200 may be disposed within pre-drilled subterranean borehole 280 (such as that generated by a HDD operations or surface trenching operations) from one end 280A of borehole 280 to another end 280B of borehole 280. Sensor apparatus 200 may be unwound from spool 281 and guided through borehole 280 by string 282. As shown in FIG. 2A, sensor apparatus 200 includes sensor device 250, as may be similar to sensor device 150 described in conjunction with FIG. 1A, disposed at least partially within first elongated housing 210. Sensor device 250 may include sensor string 250 disposed across the entire length of sensor apparatus 200.

Sensor apparatus 200 also includes second elongated housing 220 having a wall defining at least one radial port 222 for conducting material into bore hole 280. A pump (not shown) may be used to pump material into open end (224) of second elongated housing 220. In sensor apparatus 200 of FIG. 2A, radial ports (generally designated by reference numeral 222) are formed across the entire length of second elongated housing 220 to conduct material, such as a grout material, about sensor apparatus 200. Radial ports 222 may be arranged in other patterns, such as a helical pattern along a length of the second elongated housing 220, to promote the uniform distribution of material.

Figure 2B:
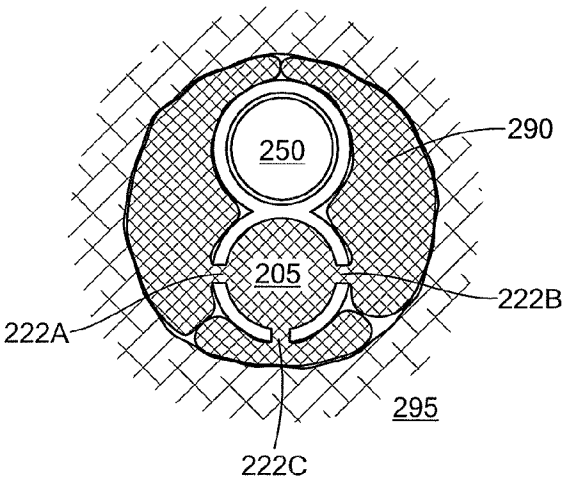
FIG. 2B is a cross-sectional view of the sensor apparatus shown in FIG. 2A at line BB'.

Referring now to FIG. 2B, in which a cross-section of sensor apparatus 200 of FIG. 2A is shown at line BB' and in which like elements of FIG. 2A are shown with like reference numerals, grout material 205 may be conducted via radial ports 222A, 222B, 222C into borehole area 290 about sensor apparatus 200. Sensor device 250 may be used to determine when bore area hole 290 is sufficiently filled with grouting material, such as to form a uniform coupling between sensor apparatus 200 and surrounding medium, a portion of which is designated by reference numeral 295. In one embodiment, sensor device 250 is configured to detect a predetermined pressure gradient according to predetermined sensor application design standards.

Figure 2C:
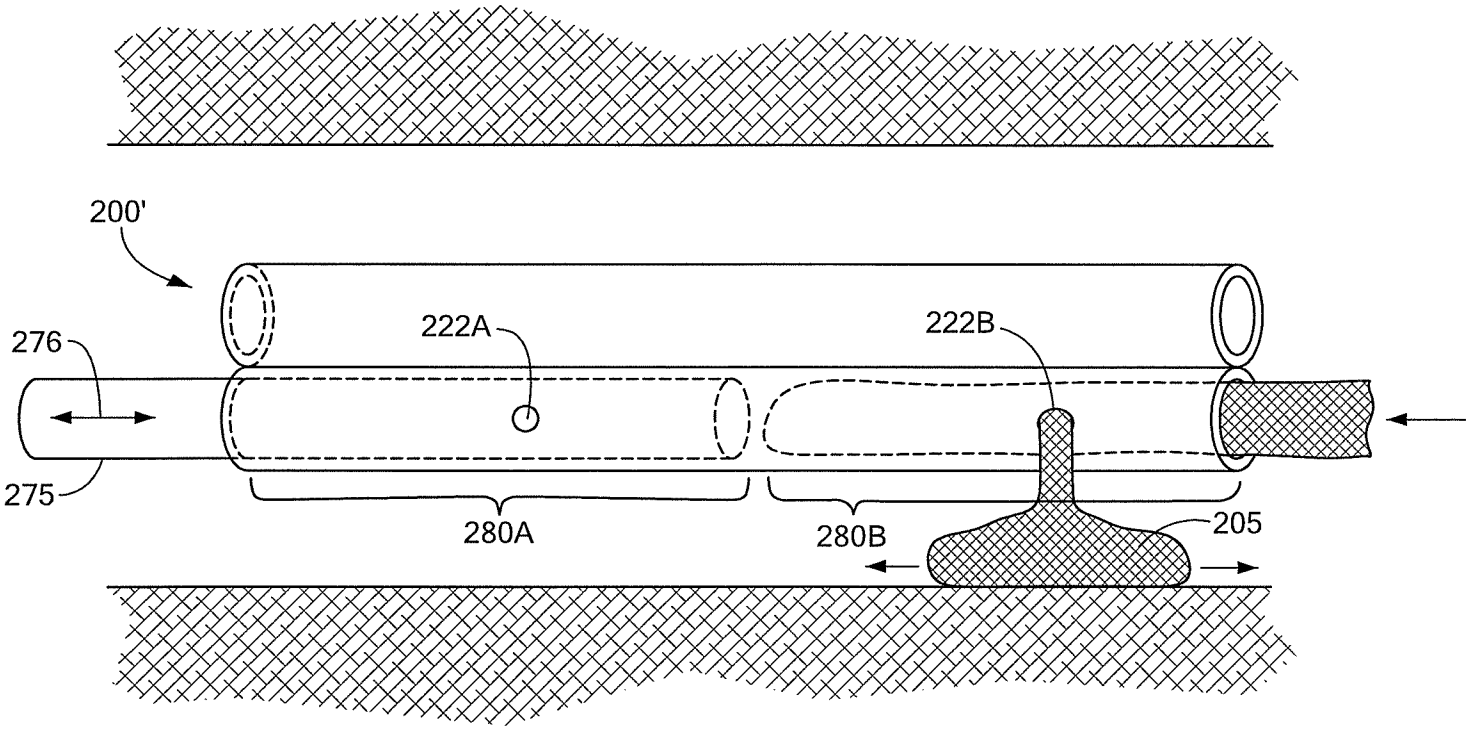
FIG. 2C is a pictorial representation of a sensor apparatus embodiment including an inner housing.

Referring now to FIG. 2C, in some sensor apparatus embodiments 200', inner housing 275 may be disposed within second elongated housing 220 to suit one or more needs of the sensing application. For example, inner housing 275 may be disposed within second elongated housing 220 and withdrawn or displaced within second elongated housing 220 during installation (as shown by line designated by reference numeral 276) as grout material 205 is pumped into second elongated housing 220. This can allow grout material 205 to be conducted at precise portions about sensor apparatus 200'. As can be seen in FIG. 2C, in one particular example, inner housing 275 is disposed within second elongated housing 220 along first portion 280A to prevent grout material 205 from flowing through one or more blocked radial ports (an example of which is designated by reference numeral 222A) along first portion 280A, while permitting grout material 205 to flow through one or more unblocked radial ports (an example of which is designated by reference numeral 222B) along second portion 280B of second elongated housing 220.

In the same or different embodiment, inner housing 275 is pushed through second elongated housing 220 after grout material 205 has been conducted about sensor apparatus 200', which may assist in sealing and seating grout material 205 and may prevent backflow and pressure when hardening.

Figure 3:
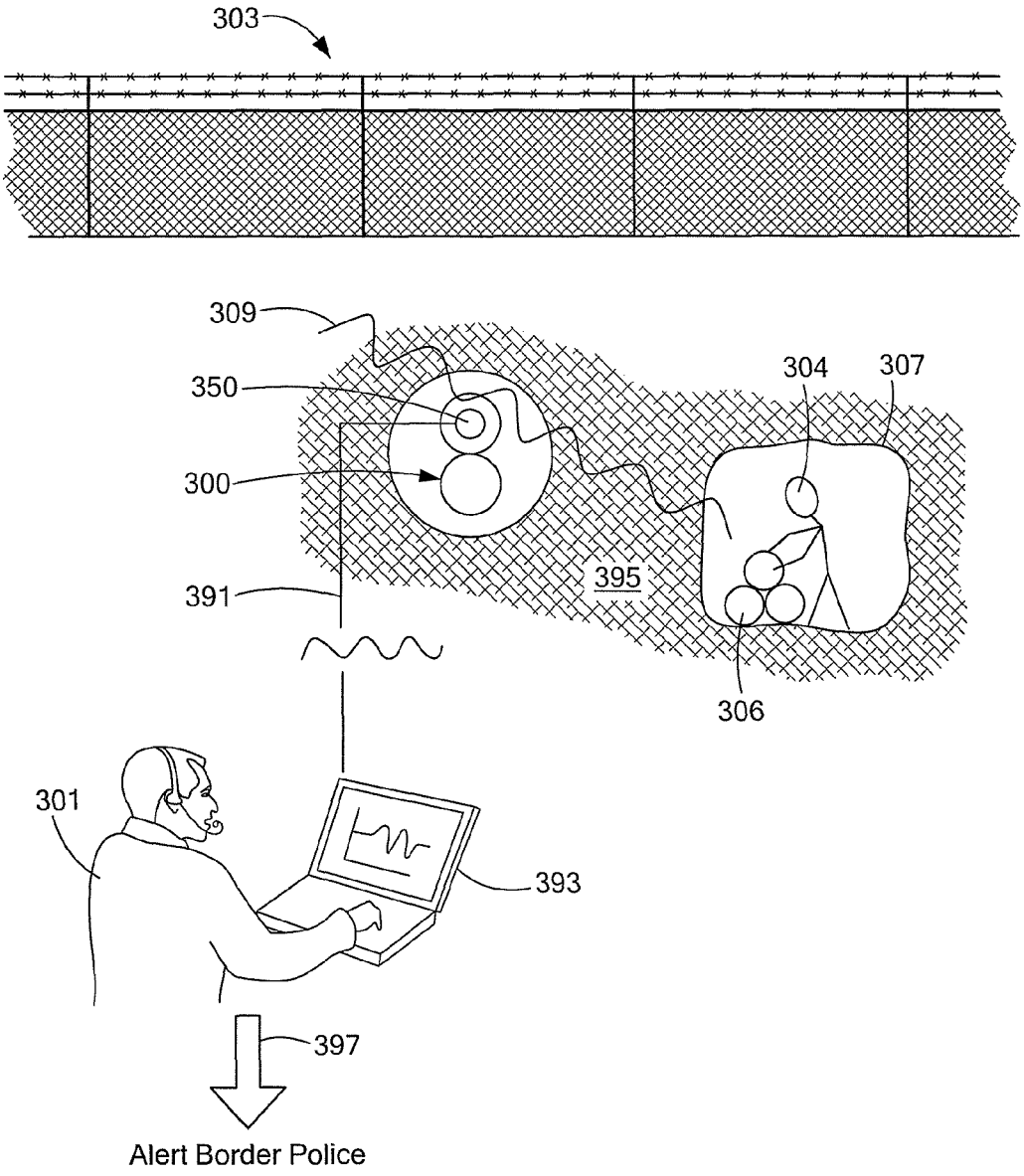
FIG. 3 is a pictorial representation of a border security operation which may incorporate a sensor apparatus described herein.

Referring now to FIG. 3, an exemplary application of a sensor apparatus described herein, although not limited to such an application, includes border security and surveillance. Border security personnel 301, such as those employed by the United States Department of Homeland Security, use sensor apparatus 300, shown in cross-sectional view, to monitor illegal activities which may occur at or near the United States border (here represented by a border security fence 303). For example, smugglers 304 may attempt to smuggle illegal materials 306 across the border via underground tunnel 307. Sensor apparatus 300 installed at or near border may detect vibrations 309 generated by the illegal activity and transmitted through surrounding soil 395. Sensor apparatus 300, and in particular sensor device 350 is configured to detect vibrations 309. Sensor device 350 is coupled by connector 391 to external system 393 to enable rendering of vibrations 309 to border security personnel 301.

In a further embodiment, sensor apparatus 300 includes electronics that are coupled to sensor device 350 and configured to process the vibrations (or any other type of sensor output) for output to external systems. For example, electronics may be coupled electronically and/or mechanically (such as by a vibrating membrane) to sensor device 350 and may amplify, filter, and/or digitize the sensed vibrations for output. Pre-amplifiers, power conditioning components, and other system components may be used for these purposes.

One of ordinary skill in the art will readily understand that the sensor apparatus described herein is not limited to border security operations, and may find use in subterranean exploration operations, such as oil and gas exploration, tunnel boring operations and surveillance, such as during the construction and monitoring of underground facilities, and subterranean infrastructure construction and maintenance, such as for fiber-optic networks and power transmission networks.

Figure 4:
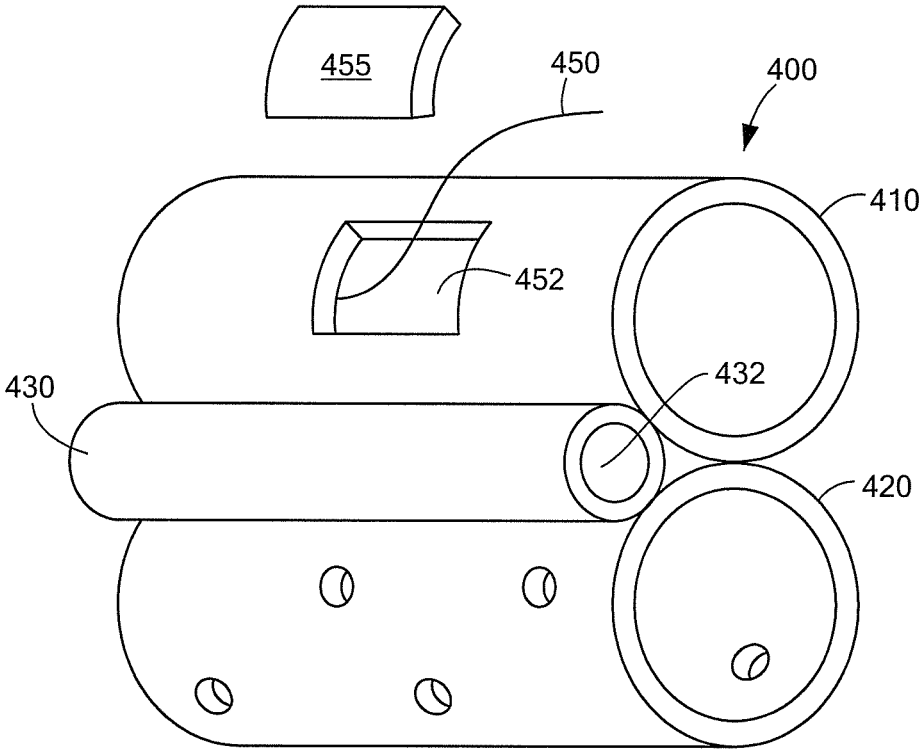
FIG. 4 is a pictorial representation of a sensor apparatus embodiment including a strength member.

Referring now to FIG. 4, in further embodiments a sensor apparatus 400 includes integral strength member 430 running a substantial length of sensor apparatus 400. Strength member 430 can handle high-tensile loads during sensor installation. Suitable materials for strength member 430 include, but are not limited to, steel, aromatic polyamide (also known as aramid), and/or other high-tensile materials. Strength member 430 is coupled longitudinally to at least one of first and second elongated housings 410, 420. In the exemplary sensor apparatus embodiment 400 of FIG. 4, strength member 430 is shown longitudinally coupled to outer surfaces of first and second elongated housing 410, 420 and adjacent to coupled surfaces of first and second elongated housing 410, 420.

In further embodiments, lumen 432 is formed within strength member 430 to at least partially enclose devices such as electronics to enable certain useful functionality, such as to enable communications from a first end of sensor apparatus 400 to a second end of sensor apparatus 400. In military applications, for example, such a configuration enables communications, such as those between a command post and one or more field posts on opposite ends of a demilitarized zone traversed by sensor apparatus 400.

Referring again to FIG. 4, in a further embodiment, sensor device 450 may be inserted and disposed within first elongated housing 410 via one or more openings, an example of which is designated by reference numeral 452, defined by first elongated housing 410 at a portion of wall 455 of first elongated housing 410. As can be seen in FIG. 4, sensor device 450 is inserted into first elongated housing 410 through opening 452. In still further embodiments, one or more other openings are formed to enable sensor device 450 to be pulled or pushed out of first elongated housing 410. After insertion of sensor device 450, opening 452 of wall 455 may be fusion-welded with first elongated housing 410 at the edges of opening 452. In still other embodiments, another material may be used to cover opening 452, such as a patch piece of material that is of the same or similar composition as first elongated housing 410 material.

Figure 5:
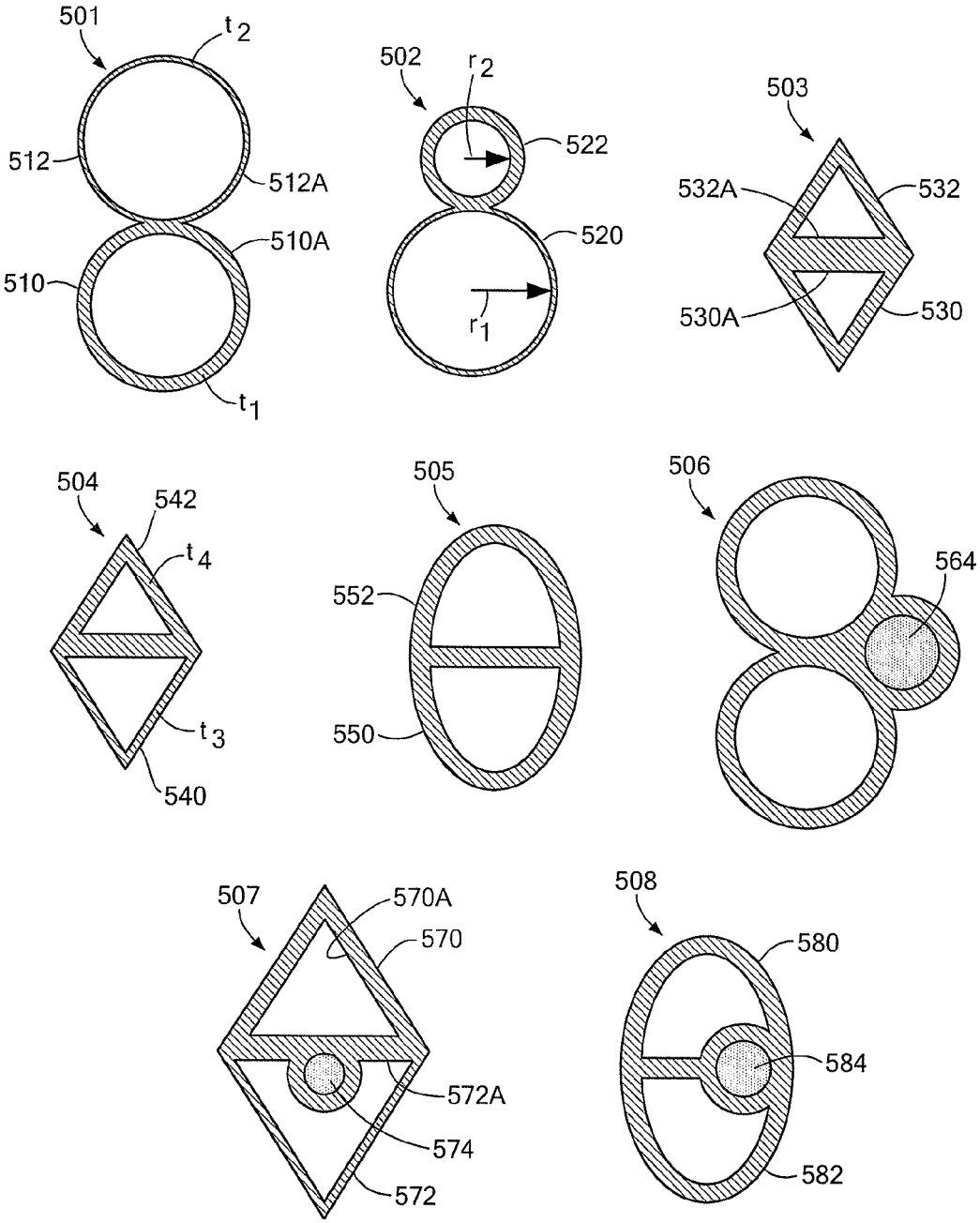
FIG. 5 is a pictorial representation of exemplary cross-sectional configurations of a sensor apparatus described herein.

Referring now to FIG. 5, various cross-sectional configurations of sensor apparatus 501, 502, 503, 504, 505, 507, 508 are shown and will now be described in more detail. Sensor apparatus 501 (shown in cross-sectional view as are all of the sensor apparatus embodiments 501-508) is an example of first elongated housing 510 and second elongated housing 512 coupled along respective outer surfaces 510A, 512A. As can be seen in FIG. 5, first and second elongated housings 510, 512 may have different respective wall thicknesses $t_1$ and $t_2$ to accommodate various design constraints and needs of the sensor application. For example, thickness $t_1$ may be greater than thickness $t_2$ to accommodate pullback strength requirements of sensor apparatus 501 during installation and reduced grout pressure.

In another embodiment, sensor apparatus 502 includes first elongated housing 520 with a relatively thin wall for enhanced sensor device sensitivity and second elongated housing 522 having a smaller radius $r_2$ than the radius $r_1$ of first elongated housing 520 and a relatively thick wall to accommodate higher grout material pressure.

In a further embodiment, sensor apparatus 503 includes first elongated housing 530 and second elongated housing 532 having triangularly-shaped cross-sectional areas. Such triangularly shaped cross-sectional areas may impart higher tensile strength and/or crush resistance due to the inherent strength of triangularly shaped structures. Here, first and second elongated housing 530, 532 have sides of substantially equal lengths (forming equilateral triangles) however the sides need not be of the same length. Furthermore, first and second elongated housings 530, 532 are coupled longitudinally along a substantial portion of respective sides 530A, 532A. In another embodiment, sensor apparatus 504 similar to sensor apparatus 503 includes first and second elongated housings 540, 542 with different respective wall thicknesses $t_3$ and $t_4$.

In another embodiment, sensor apparatus 505 has an oval-shaped cross-sectional area which is split in half to form first elongated housing 550 and second elongated housing 552. The oval shape may impart increased resistance to tangling of sensor apparatus 505, as may occur during installation and/or due to shifting ground during the lifetime of the sensor. It will be understood that sensor apparatus 505 may be divided in other ways, such as toward one end of the oval or the other end of the oval and/or diagonally.

In a further embodiment, sensor apparatus 506 similar to sensor apparatus 501 includes strength member 564, as may be similar to strength member 430 described in conjunction with FIG. 4.

In another embodiment, sensor apparatus 507 similar to sensor apparatus 503 and 504 includes strength member 574. Here, strength member 574 occupies an inner area and is coupled to inner surface 572A of second elongated housing 572; however, one of ordinary skill in the art will recognize that strength member 574 may be coupled to other portions of sensor apparatus 507, such as inner surface 570A of first elongated housing 570.

In a further embodiment, sensor apparatus 508 similar to sensor apparatus 505 includes strength member 584. Here, strength member 584 occupies substantially equal inner areas of first elongated housing 580 and second elongated housing 582. Containing strength member 584 within the inner areas instead of along the outer surfaces of the housings results in a smaller cross-sectional area of sensor apparatus 508 and may simplify extrusion of sensor apparatus 508.

Figure 6:
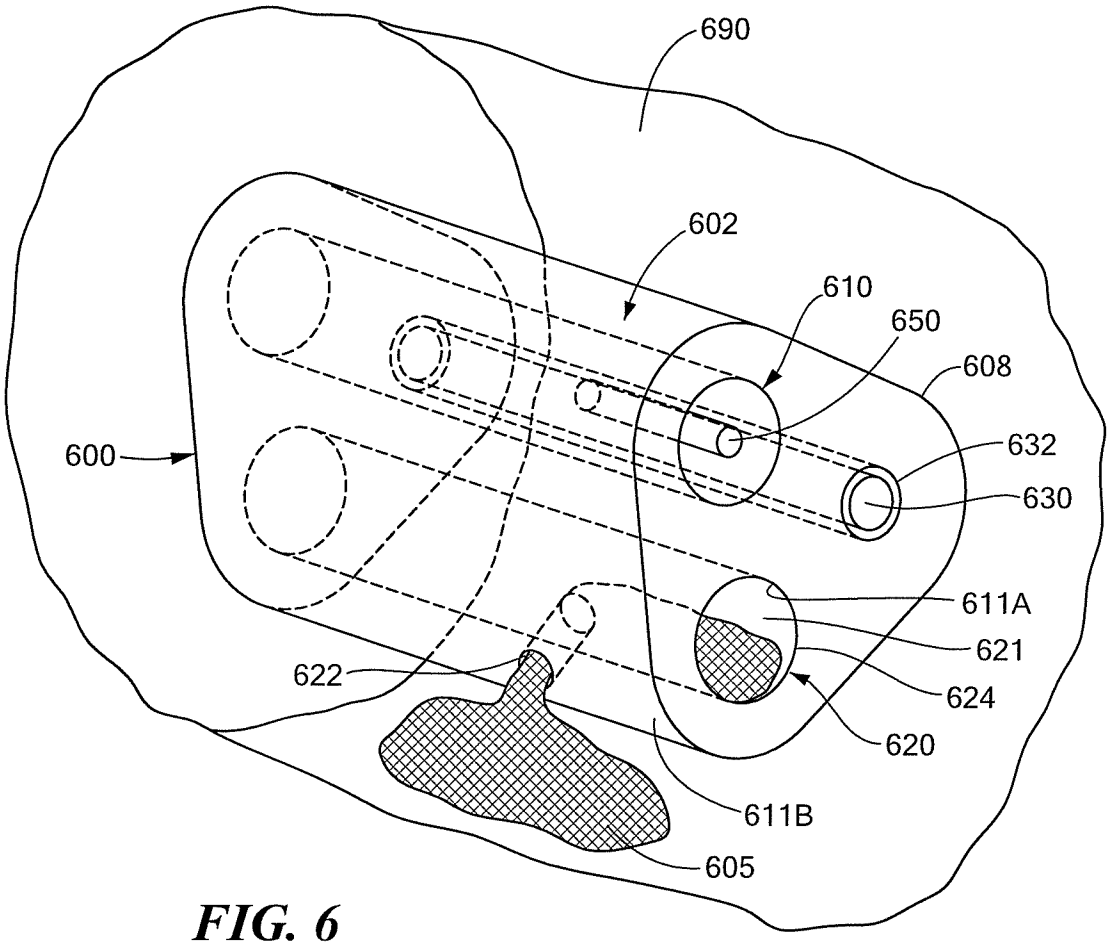
FIG. 6 is a pictorial representation of another embodiment of a sensor apparatus described herein.

Referring now to FIG. 6, in another aspect, the inventive techniques, systems, and concepts include sensor apparatus 600 (shown in FIG. 6 in perspective view) including elongated sensor body 602 forming first lumen 610 to at least partially enclose sensor device 650 and second lumen 620 having portion 621 parallel to elongated sensor body 602 and radial port portion 622 extending from parallel portion 621 of second lumen 620 to outer surface 611B of elongated sensor body 602. Second lumen 620 acts to conduct material 605 through parallel portion 621 and through radial port portion 622 to a position about sensor apparatus 600. As can be seen in FIG. 6, sensor apparatus embodiment 600 has smooth outer surface 608 which can reduce interference and/or entanglement with other objects and devices in borehole 690 (shown in FIG. 6 in cutout perspective view). In a further embodiment, sensor apparatus 600 includes third lumen 632 at least partially enclosing strength member 630, which may be similar to strength member 430 described in conjunction with FIG. 4.

Figure 7:
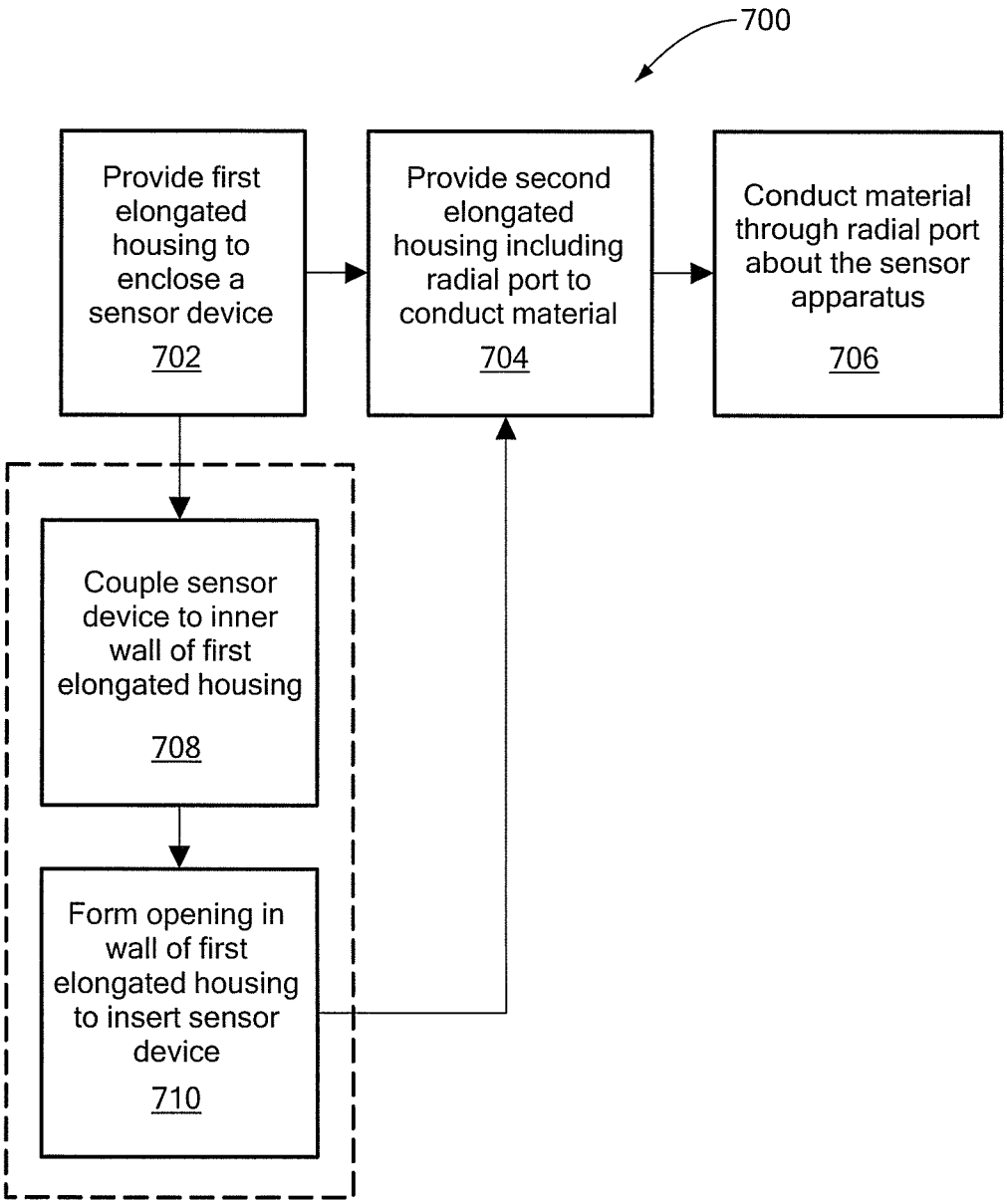
FIG. 7 is a block diagram of an embodiment of a method for installing a sensor apparatus as described herein.

Referring now to FIG. 7, a method 700 of installing a sensor apparatus includes providing a first elongated housing to at least partially enclose sensor device 702, and providing a second elongated housing coupled longitudinally to first elongated housing 704. The second elongated housing includes at least one radial port extending from an inner surface to an outer surface of the second elongated housing. The method 700 further includes displacing a material through the second elongated housing and out at least one radial port in the second elongated housing to allow material to be positioned near the sensor device.

In a further embodiment, the method 700 further includes coupling the sensor device to an inner wall of first elongated housing 708 and/or forming an opening in a wall of the first elongating housing to insert at least a portion of the sensor device within the first elongating housing 710.

Having described exemplary embodiments of the invention, it will now become apparent to one of ordinary skill in the art that other embodiments incorporating their concepts may also be used. The embodiments contained herein should not be limited to disclosed embodiments but rather should be limited only by the spirit and scope of the appended claims. All publications and references cited herein are expressly incorporated herein by reference in their entirety.

What is claimed is:

1. A sensor apparatus, comprising:

a first elongated housing having a first length and configured to at least partially enclose a sensor device; and a second elongated housing generally parallel to the first elongated housing, the second elongated housing having a second length and defining at least one radial port extending from an inner surface to an outer surface of the second elongated housing adapted to conduct a material through the second elongated housing and out the radial port about the sensor apparatus, wherein the first length of the first elongated housing and the second length of the second elongated housing are configured to allow the first and second elongated housings to be disposed down into a subterranean borehole, wherein the first elongated housing and the second elongated housing are configured to be substantially in contact with each other over at least those portions of their lengths disposed in the subterranean hole.

2. The sensor apparatus of claim 1, wherein the first elongated housing has a generally circular cross-sectional area and the second elongated housing has a generally circular cross-sectional area and the outer surface of the second elongated housing is coupled along a length of the sensor apparatus to an outer surface of the first elongated housing.

3. The sensor apparatus of claim 2, wherein the first elongated housing has a first radius and the second elongated housing has a second radius, wherein the first radius is larger than the second radius.

4. The sensor apparatus of claim 2, wherein the first elongated housing has a wall having a first thickness and the second elongated housing has a wall having a second thickness, the second thickness larger than the first thickness.

5. The sensor apparatus of claim 1, wherein the first elongated housing has a generally triangular cross-sectional area and the second elongated housing has a generally triangular cross-sectional area.

6. The sensor apparatus of claim 5, wherein the first elongated housing has a wall having a first thickness and the second elongated housing has a wall having a second thickness, the second thickness larger than the first thickness.

7. The sensor apparatus of claim 1, wherein the sensor apparatus has a generally oval-shaped cross-sectional area, the first elongated housing disposed within a first portion of the oval-shaped cross-sectional area and the second elongated housing disposed within a second portion of the oval-shaped cross-sectional area.

8. The sensor apparatus of claim 1, wherein the sensor device includes a sensor string at least a portion of which is coupled to an inner surface of the first elongated housing to enhance sensor sensitivity, the sensor string including at least one of: a plurality of acoustic sensors and a plurality of seismic sensors.

9. The sensor apparatus of claim 1, wherein a coupling material formed about the sensor device couples the sensor device to the inner surface of the first elongated housing.

10. The sensor apparatus of claim 9, wherein the coupling material includes a fluid material.

11. The sensor apparatus of claim 1, wherein an inner surface and an outer surface of the first elongated housing form a first wall having a thickness configured to enhance sensor sensitivity and an inner surface and an outer surface of the second elongated housing form a second wall having a thickness to enhance tensile strength of the sensor apparatus.

12. The sensor apparatus of claim 1, wherein the at least one radial port includes a plurality of radial ports arranged in a helical pattern along a length of the second elongated housing.

13. The sensor apparatus of claim 1, wherein the at least one radial port includes a plurality of at least two radial ports arranged at a density along a length of the second elongated housing to support uniform distribution of the material.

14. The sensor apparatus of claim 1, wherein the at least one radial port includes a plurality of radial ports, further comprising:

an inner housing disposed within at least a portion of the second elongated housing to block distribution of the material through at least one of the radial ports.

15. The sensor apparatus of claim 1, further comprising an elongated member coupled longitudinally to at least one of the first and second elongated housings.

16. The sensor apparatus of claim 15, wherein the first elongated housing has a generally triangular cross-sectional area and the second elongated housing has a generally triangular cross-sectional area and the elongated member is housed within one of the first and second elongated housings.

17. The sensor apparatus of claim 15, wherein the sensor apparatus has a generally oval-shaped cross-sectional area, first elongated housing disposed within a first portion of the oval-shaped cross-sectional area, the second elongated housing disposed within a second portion of the oval-shaped cross-sectional area, and the elongated member disposed within at least one of the first and second portions.

18. The sensor apparatus of claim 15, wherein electronics are disposed in a lumen formed within the elongated member.

19. A sensor apparatus, comprising:

an elongated sensor body forming:

a first lumen having a first length and into which a sensor device may be inserted; and a second lumen having a second length, a portion parallel to the elongated sensor body and a radial port portion extending from the portion parallel to the elongated sensor body to an outer surface of the elongated sensor body, the second lumen acting to conduct a material through the parallel portion of the second lumen and through the radial port portion of the second lumen to a position about the sensor apparatus, wherein the first length of the first lumen and the second length of the second lumen are configured to allow the first and second lumens to be disposed down into a subterranean borehole, wherein the first lumen and the second lumen are configured to be substantially in contact with each other over their lengths for at least those portions of their lengths disposed in the subterranean hole.

20. The sensor apparatus of claim 19, wherein the first lumen has a generally circular cross-sectional area and the second lumen has a generally circular cross-sectional area.

21. The sensor apparatus of claim 19, wherein the sensor device includes a sensor string at least a portion of which is coupled to an inner surface of the first lumen to enhance sensor sensitivity, the sensor string including at least one of: a plurality of acoustic sensors and a plurality of seismic sensors.

22. The sensor apparatus of claim 19, wherein a coupling material formed about the sensor string couples the sensor to the inner surface of the first lumen, the coupling material including a fluid material.

23. The sensor apparatus of claim 19, wherein an inner surface and an outer surface of the first lumen form a first wall having a thickness configured to enhance sensor sensitivity and an inner surface and an outer surface of the second lumen form a second wall having a thickness to enhance tensile strength of the sensor apparatus.

24. The sensor apparatus of claim 19, wherein the radial port portion includes a plurality of radial port portions arranged in a helical pattern along a length of the second lumen.

25. The sensor apparatus of claim 19, wherein the radial port portion includes a plurality of radial port portions, further comprising:

an inner member disposed within at least a portion of the second lumen to block distribution of the material through at least one of the radial port portions.

26. The sensor apparatus of claim 19, wherein the elongated sensor body further forms a third lumen and further including a strength member located within the third lumen.

* * * * *